US005896878A

United States Patent [19]

Shogatsudani

[11] Patent Number: 5,896,878

[45] Date of Patent: Apr. 27, 1999

[54] PIPE WASHING APPARATUS

[75] Inventor: Nobuyoshi Shogatsudani, Tokyo, Japan

[73] Assignee: Shinsho Limited, Tokyo, Japan

[21] Appl. No.: 08/937,113

[22] Filed: Sep. 24, 1997

[51] Int. Cl.[6] ..... B08B 9/04

[52] U.S. Cl. ..... 134/167 C; 134/172; 134/198

[58] Field of Search ..... 134/167 C, 168 C, 134/169 C, 172, 198

[56] References Cited

U.S. PATENT DOCUMENTS

| | | | |
|---|---|---|---|
| 4,206,313 | 6/1980 | Cavretto | 134/167 C |
| 4,361,282 | 11/1982 | Divito | 134/167 C |
| 4,699,163 | 10/1987 | Baziuk | 134/167 C |
| 4,756,324 | 7/1988 | Larsson | 134/167 C |
| 4,819,314 | 4/1989 | Shaddock | 134/167 C |
| 4,985,763 | 1/1991 | Fraser | 134/167 C |
| 5,125,425 | 6/1992 | Folts et al. | 134/167 C |
| 5,179,753 | 1/1993 | Flaherty et al. | 134/167 C |

FOREIGN PATENT DOCUMENTS

| | | |
|---|---|---|
| 2-207879 | 8/1990 | Japan . |
| 4-200781 | 7/1992 | Japan . |

*Primary Examiner*—Frankie L. Stinson
*Attorney, Agent, or Firm*—Nikaido, Marmelstein, Murray & Oram LLP

[57] ABSTRACT

In order to provide an improved pipe washing apparatus guaranteed to be free of the wearing and/or breaking of nozzle shaft, it is provided with a nozzle support to be fixed to the end of a washing hose, which is to be inserted in a pipe to be washed inside, a cylindrical nozzle rotatably fixed to the nozzle support and a nozzle guide member fixed to the forward end of the nozzle for guiding the nozzle along the inner circumference of the pipe. The nozzle support has a longitudinal water channel made along its center axis and closed at its forward end, and lateral jet outlets extending from the longitudinal water channel to open on the cylindrical circumference of the nozzle support. The cylindrical nozzle has a circumferential water chamber made on the inner circumference of the cylinder to communicate with the lateral jet outlets, first, circumferentially oblique jet outlets for rotating the nozzle and second, backward oblique jet outlets for driving the pipe washing apparatus forward, and a lubricating water channel is delimited between the nozzle support and the nozzle to communicate with the circumferential water chamber.

4 Claims, 3 Drawing Sheets

PIPE WASHING APPARATUS

BACKGROUND OF THE INVENTION

1. Field of the Invention

The present invention relates to an improvement in or relating to a pipe washing apparatus for use in cleaning for instance, drain ducts, which pipe washing apparatus is capable of running forward and circumferentially in the pipe while scrubbing and washing away the scales thus removed.

2. Description of Related Art

A conventional pipe washing apparatus is disclosed in Japanese Patent 4-200781(A). As shown in FIG. 6, it comprises a nozzle support 1 fixed to the end of a washing hose H, which is to be inserted in a pipe B to be washed inside, a nozzle 2 attached to the nozzle support 1 and a slender nozzle guide member 3 extending from the nozzle 2. The nozzle 2 has a first radial water-jet throttle 2*a* directed radially to the inner circumference of the pipe B. The nozzle support 1 has second oblique water jet throttles 1*c* directed obliquely backward for driving the pipe washing apparatus forward.

Japanese Patent 2-207879(A) shows another pipe washing apparatus. As shown in FIG. 7, it comprises a nozzle support 1 fixed to the end of a washing hose H, which is to be inserted in a pipe B to be washed inside, a nozzle 2 rotatably attached to the nozzle support 1 and a slender nozzle guide member 3 extending from the nozzle 2 forward. The nozzle support 1 has orifices (second water jet throttles) 1*c*. The nozzle 2 has a radial water-jet throttle (first water-jet throttle) 2*a*. The orifice 1*c* of the nozzle support 1 is smaller than the water-jet throttle 2*a* of the nozzle 2. The slender nozzle guide member 3 extends aside from the center axis of the longitudinal channel of the nozzle 2.

As for the pipe washing apparatus shown in Japanese Patent 4-200781(A) the nozzle 2 is fixed to the cylindrical end 1*d* of the nozzle support 1 via an associated bearing 6, and the guide member 3, which is composed of a slender stem 3*a* having a ball 3*b* fixed to its end, is fixed to one side of the nozzle 2. The massive spherical end 3*b* of the slender stem 3*a* is put aside from the center of rotation about which the nozzle 2 is rotated. This cantilever-like support structure is disadvantageous to the rotating of the nozzle 2 while jetting water to the inner circumference of the pipe B for scraping; such cantilever-like support structure burdens undue load on the nozzle shaft 2*e* , causing an increased bending moment to be applied to the nozzle shaft 2*e*. This is the main cause for the significant wearing or breaking of the nozzle assembly.

As for the pipe washing apparatus shown in Japanese Patent 2-207879(A) this has a similar cantilever-like support structure to hold a nozzle guide member, the stem of which is even longer than the nozzle guide member in the pipe washing apparatus shown in Japanese Patent 4-200781(A). To assure that undesired vibration caused by the rotating nozzle guide 3 is prevented the bearing 6 of the nozzle shaft must be mounted deep in the hollow nozzle support 1. Thus, extra manufacturing cost is involved.

SUMMARY OF THE INVENTION

In view of the above one object of the present invention is to provide a pipe washing apparatus which is simple in structure, and is free of shaft wearing and breaking, assuring that the nozzle is rotated smoothly without recourse to bearings.

To attain this object a pipe washing apparatus according to the present invention comprises: a nozzle support to be fixed to the end of a washing hose, which is to be inserted in a pipe to be washed inside, said nozzle support having a longitudinal water channel made along the center axis of the nozzle support and closed at the forward end of the water channel, and lateral or radial jet outlets extending from said longitudinal water channel to open on the cylindrical circumference of the nozzle support; a cylindrical nozzle rotatably fixed to the nozzle support, said cylindrical nozzle having a circumferential water chamber made on the inner circumference of the cylinder to communicate with said lateral jet outlets, first circumferentially oblique jet outlets for rotating said nozzle and second backward oblique jet outlets for driving said pipe washing apparatus forward; a lubricating water channel delimited between said nozzle support and said nozzle to communicate with said circumferential water chamber; and a nozzle guide member fixed to the forward end of said nozzle for guiding the nozzle along the inner circumference of the pipe.

In operation pressurized water is supplied to the nozzle to fill the circumferential water chamber with pressurized water, allowing water to jet from the circumferentially and backward oblique jet outlets, thereby washing and scraping the inner circumference of the pipe and, at the same time, driving the apparatus forward. Specifically, the pressurized water jets from the first, circumferentially oblique jet outlets of the nozzle drive the washing apparatus toward the inner circumference of the pipe (see FIG. 4) so that the washing apparatus strikes against the inner circumference of the pipe, and then, it is pushed against the inner circumference of the pipe while water is jetting from each of the first jet outlets of the nozzle at the jet angle of $\theta$ to start creeping on the inner circumference of the pipe B with the guide ball scrubbing it (see FIG. 5). Thus, the washing apparatus runs on the inner circumference of the pipe B to remove scales therefrom and wash the so removed scales away backward. The pressurized water jet from the second, backward oblique jet outlets drives the washing apparatus forward. Also, the pressurized water flows from the circumferential water chamber, passing through the lubricating area delimited between the nozzle support and the nozzle, thereby assuring that the nozzle rotates smoothly, causing no significant wearing around its shaft.

The nozzle support may have a cylindrical section of reduced diameter, and the cylindrical nozzle may be rotatably fixed to the cylindrical section of reduced diameter of the nozzle support. This arrangement permits the nozzle to be flush with the nozzle support, thereby causing no scales to be caught and invade into the nozzle-to-support joint, which otherwise, would be step-up or step-down to catch scales. Such invasion of scales into the nozzle would cause an adverse effect on the smooth rotating of the nozzle.

The longitudinal water channel may have a closure plate bolted to the end of the nozzle support to close the forward end of the longitudinal water channel, and the nozzle guide member may comprise a relatively short stem extending from the forward end of the nozzle and ending with a guide ball. This arrangement has the effect of reducing the load on the nozzle, and hence substantially reducing the amplitude of vibration caused by the rotating of the guide ball.

Other objects and advantages of the present invention will be understood from the following description of a pipe washing apparatus according to one embodiment of the present invention, which is shown in accompanying drawings.

DESCRIPTION OF THE PREFERRED EMBODIMENTS

Figure 1:
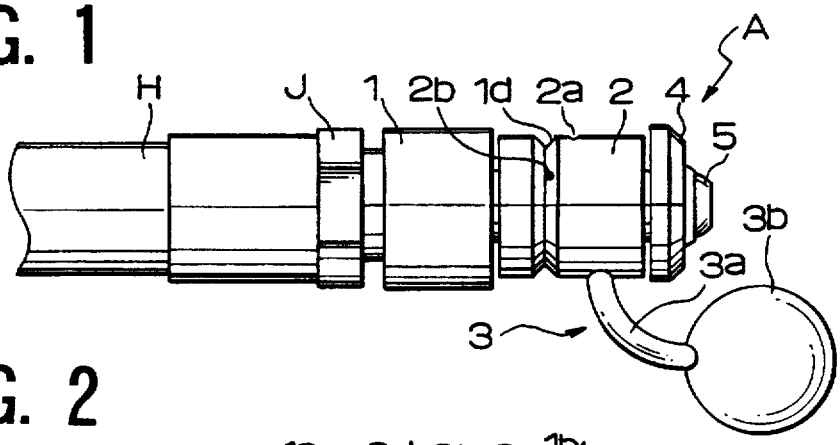
FIG. 1 is a side view of a pipe washing apparatus according to the present invention.
Figure 2:
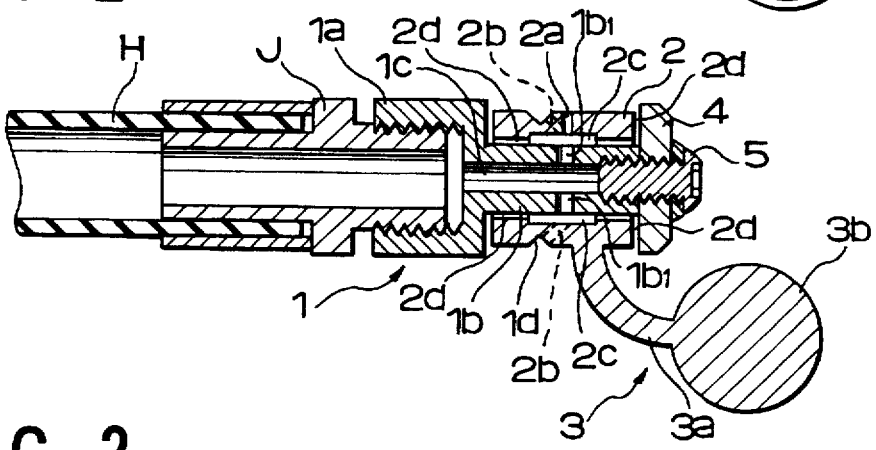
FIG. 2 is a longitudinal section of the pipe washing apparatus.

Referring to FIGS. 1 and 2, a pipe washing apparatus "A" according to the present invention comprises a nozzle support 1 fixed to the end of a washing hose "H", which is to be inserted in a pipe "B" to be washed inside, a cylindrical nozzle 2 rotatably fixed to the nozzle support 1 and a nozzle guide member 3 fixed to the forward end of the nozzle 2 for guiding the nozzle 2 along the inner circumference of the pipe "B".

Referring to FIG. 2, the nozzle support 1 is composed of a hollow cylinder having a longitudinal water channel made along its center axis, and its enlarged joint end 1*a* is threadedly engaged with the hose joint "J" of the washing hose "H". The longitudinal cylindrical section of reduced diameter 1*b* fits in the annular nozzle 2. The nozzle support 1 has lateral jet outlets 1*b*1 extending from the longitudinal water channel 1*c* to open on its cylindrical circumference.

The cylindrical nozzle 2 is a hollow cylinder opening at its opposite ends, and it is loosely fitted on the longitudinal cylindrical section of reduced diameter 1*b* of the nozzle support 1. A closure plate 4 is fixed to the end of the nozzle support 1 by a screw 5, thereby hermetically closing the forward end of the longitudinal water channel 1*c*, still permitting the nozzle 2 to rotate about the nozzle support 1. The cylindrical nozzle 2 has a circumferential water chamber 2*c* made on its inner circumference to communicate with the lateral jet outlets 1*b*1 of the nozzle support 1. Also, it has a first, circumferentially oblique jet outlet 2*a* for rotating the nozzle 2 and second, backward oblique jet outlets 2*b* for driving the pipe washing apparatus "A" forward. A lubricating water layer is provided between the nozzle support 1 and the nozzle 2 to communicate with the circumferential water chamber 2*c*.

Figure 3:
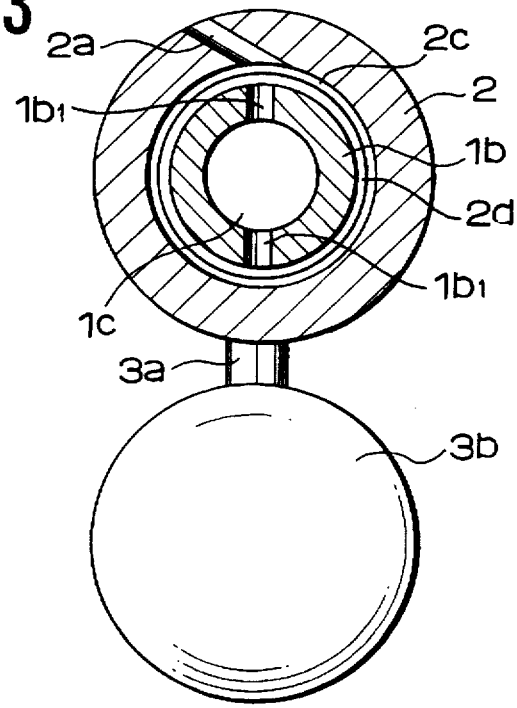
FIG. 3 is a cross section of the pipe washing apparatus.

The first radial jet outlet 2*a* is contained in a plane normal or perpendicular to the axial center of the longitudinal channel 1*c*, and is oriented at the angle θ relative to the rotating direction, as seen from FIG. 3. This angle θ has the effects of assuring the smooth rotation of the nozzle 2 and of determining the rotating direction of the nozzle 2. The angle θ is preferably set to be small for an increasing size of pipe.

Figure 4:
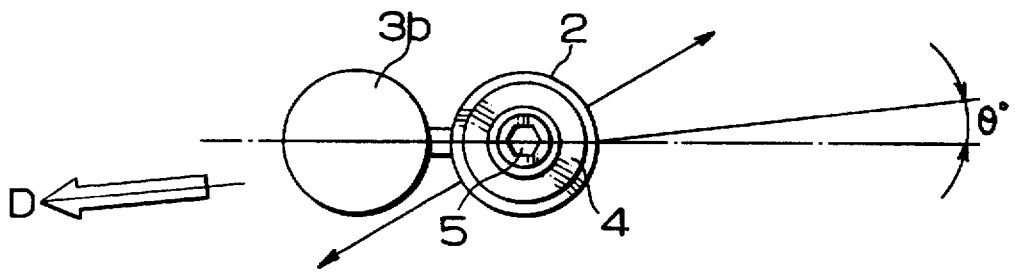
FIG. 4 shows how the pipe washing apparatus is thrown against the inner circumference of the pipe.

Referring to FIG. 4, the angle θ is selected to be within 0 to several degrees, and the increasing of the angle beyond such upper limit will cause the pipe washing apparatus to rotate apart from the inner circumference of the pipe "B" rather than revolve and run therealong. The angle θ is reduced close to zero as the diameter of the pipe increases.

As for the second, backward oblique jet outlets 2*b* the cylindrical nozzle support 1 has a "V"-shaped notch 1*d* made therearound, and the backward oblique jet outlets 2*b* are made in the cylindrical nozzle support 1 to be inclined at about 30 degrees relative to the center axis of the cylinder, opening at the "V"-shaped notch 1*d*. The pressurized water jets from these backward oblique jet outlets 2*b* drive the pipe washing apparatus forward, and at the same time, the scales removed from the inner circumference of the pipe "B" are washed away.

As for the circumferential water chamber 2*c* it is formed by making a recess on the inner circumferential surface of the nozzle 2 to confront the lateral jet outlets 1*b*1 of the nozzle support 1 and communicate with the first and second jet outlets 2*a* and 2*b*. The pressurized water flushing from the radial jet outlets 1*b*1 of the nozzle support 1 are led to the first and second jet outlets 2*a* and 2*b* via the circumferential water chamber 2*c*, and to the lubricating channel 2*d*, thereby providing the water layer spreading between the outer circumference of the cylindrical section 1*b* of reduced diameter and the inner circumference of the nozzle 2. Thus, the nozzle 2 can rotate smoothly about the circumference of the cylindrical section 1*b* of reduced diameter, reducing the friction and hence wearing between the nozzle support 1 and the nozzle 2.

As for the nozzle guide member a relatively short stem 3*a* extends from the forward end of the nozzle 2, and it ends with a guide ball 3*b*. The ball 3*b* is of a rigid material, and is for instance, about 16 millimeters in diameter. The ball 3*b* is positioned about 16 millimeters ahead of the head plate 4.

Figure 5:
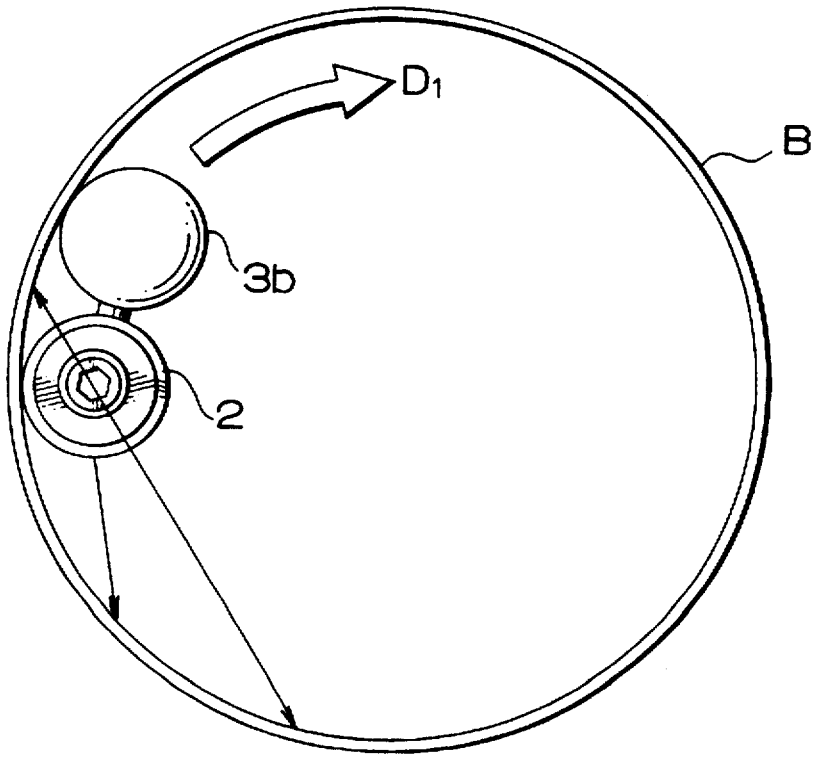
FIG. 5 shows how the pipe washing apparatus works.
Figure 6:
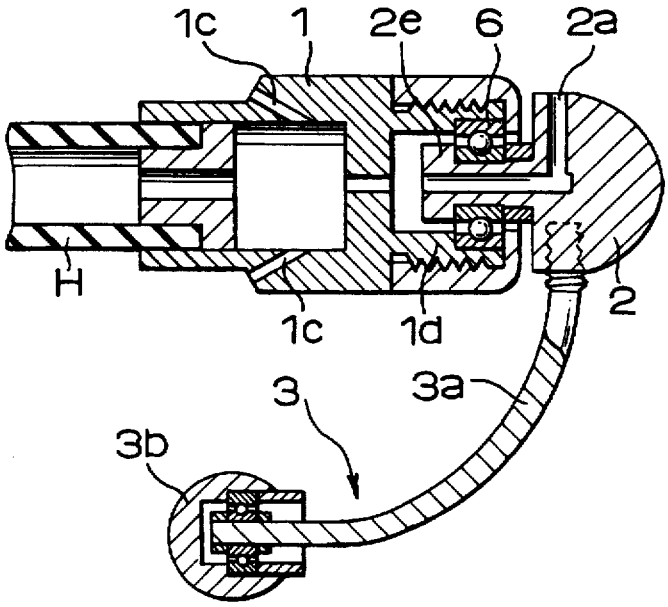
FIG. 6 PRIOR ART
FIG. 6 is a longitudinal section of a conventional pipe washing apparatus.
Figure 7:
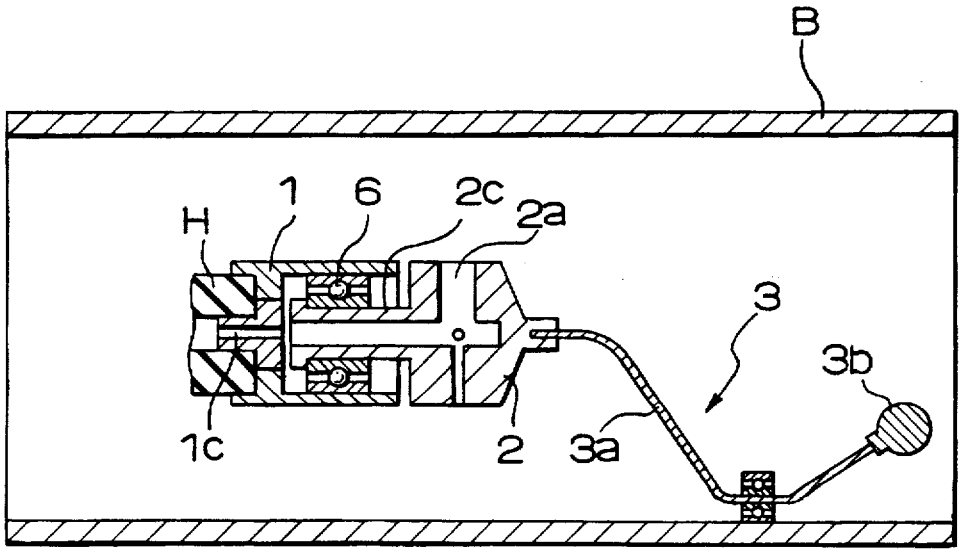
FIG. 7 PRIOR ART
FIG. 7 is a longitudinal section of another conventional pipe washing apparatus.

In use, pressurized water is supplied from a high-pressure pump to the pipe washing apparatus via the hose "H", and then, the pressurized water shoots forth from the lateral jet outlets 1*b*1 of the nozzle support 1 into the water chamber 2*c* between the nozzle support 1 and the nozzle 2, shooting forth from the first jet outlet 2*a*. Thus, the pipe washing apparatus is driven in the direction indicated by arrow "D" (see FIG. 4) to strike against the inner circumference of the pipe "B", so that the nozzle 2 is pushed against the inner circumference of the pipe "B", starting the revolving in the direction indicated by arrow "D" (see FIG. 5) while the pressurized water shoots forth from the oblique jet outlets 2*b* of the nozzle support 1. Thus, the nozzle 2 runs spirally on the inner circumference of the pipe "B", washing away the scales removed from the pipe "B".

The nozzle 2 rotates on the water bearing, which is provided by the flowing of pressurized water between the nozzle support 1 and the nozzle 2.

For pipes whose diameters range from 18 to 150 millimeters the nozzle 2 may be designed within the following ranges: 16 to 100 millimeters in diameter; 30 to 180 millimeters in length; and 0.03 to 8 kilograms in weight. Water is supplied at the pressure ranging from 25 to 250 kg/cm2. The number and angular positions of the first and second jet outlets 2*a* and 2*b* may be selected to meet particular demands.

What is claimed is:

1. A pipe washing apparatus comprising: a nozzle support designed to be fixed to an end of a washing hose, which is to be inserted into a pipe that is to be washed inside, the nozzle support having a longitudinal water channel made along a center axis of the nozzle support and closed at a forward end of the water channel, and lateral jet outlets extending from the longitudinal water channel wherein the lateral jet outlets open on a cylindrical circumference of the nozzle support; a cylindrical nozzle rotatably attached to the nozzle support, the cylindrical nozzle having a circumferential water chamber made on an inner circumference of the cylindrical nozzle communicating with the lateral jet outlets, first circumferentially oblique jet outlets for rotating the cylindrical nozzle and second backward oblique jet outlets for driving the pipe washing apparatus forward; a lubricating water channel delimited between the nozzle support and the cylindrical nozzle communicating with the circumferential water chamber; and a nozzle guide member fixed to a forward end of the cylindrical nozzle for guiding the nozzle along an inner circumference of the pipe.

2. A pipe washing apparatus according to claim 1, wherein the nozzle support has a cylindrical section of reduced diameter and the cylindrical nozzle is rotatably attached to the cylindrical section of reduced diameter of the nozzle support.

3. A pipe washing apparatus according to claim 1, wherein the longitudinal water channel has a closure plate bolted to an end of the nozzle support to close the forward end of the longitudinal water channel.

4. A pipe washing apparatus according to claim 1, wherein the nozzle guide member comprises a relatively short stem extending from a forward end of the cylindrical nozzle and ending with a guide ball.

* * * * *